US007153104B2

(12) United States Patent
Eberhardt et al.

(10) Patent No.: US 7,153,104 B2
(45) Date of Patent: Dec. 26, 2006

(54) METHOD FOR INTRODUCING AND ACTIVATING A GETTER IN A VACUUM VESSEL AND GETTER UNIT

(75) Inventors: Hans-Frieder Eberhardt, Giengen-Burgberg (DE); Jürgen Hirath, Bayreuth (DE); Jürgen Konrad, Ulm/Donau (DE); Matthias Mrzyglod, Ulm (DE); Udo Wenning, Giengen/Brenz (DE); Ulrich Wolf, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 42 days.

(21) Appl. No.: 10/643,818

(22) Filed: Aug. 19, 2003

(65) Prior Publication Data

US 2004/0141850 A1 Jul. 22, 2004

Related U.S. Application Data

(63) Continuation of application No. PCT/EP02/01409, filed on Feb. 11, 2002.

(30) Foreign Application Priority Data

Feb. 19, 2001 (DE) ..... 101 07 651

(51) Int. Cl.
*F04B 37/02* (2006.01)

(52) U.S. Cl. ..... 417/48; 417/51; 417/53; 417/572

(58) Field of Classification Search ..... 417/48, 417/51, 53, 572
See application file for complete search history.

(56) References Cited

U.S. PATENT DOCUMENTS

| | | | | |
|---|---|---|---|---|
| 3,114,469 | A | 12/1963 | Francis et al. | |
| 3,364,649 | A | 1/1968 | Sereda | |
| 4,272,259 | A * | 6/1981 | Patterson et al. | 95/95 |
| 4,704,068 | A * | 11/1987 | TheiBen et al. | 417/48 |
| 4,938,667 | A * | 7/1990 | della Porta | 417/48 |
| 5,328,336 | A * | 7/1994 | Nowobilski | 417/48 |

* cited by examiner

*Primary Examiner*—Anthony D. Stashick
*Assistant Examiner*—Ryan P. Gillan
(74) *Attorney, Agent, or Firm*—Craig J. Loest; Russell W. Wamock

(57) ABSTRACT

To prevent partial saturation of a getter by contact with absorbable atmospheric gases when the getter is introduced into a vacuum vessel, a method for introducing and activating the getter and a getter unit includes introducing the getter into the vacuum vessel packaged in a protective sleeve, closing off the vacuum vessel, evacuating the vessel, and opening the protective sleeve only after the evacuation has commenced. The protective sleeve can be opened by the sleeve being made to burst under the action of a protective gas atmosphere that is present.

1 Claim, 4 Drawing Sheets

METHOD FOR INTRODUCING AND ACTIVATING A GETTER IN A VACUUM VESSEL AND GETTER UNIT

CROSS-REFERENCE TO RELATED APPLICATION

This application is a continuation of copending International Application No. PCT/EP02/01409, filed Feb. 11, 2002, which designated the United States and was not published in English.

BACKGROUND OF THE INVENTION

Field of the Invention

The present invention relates to a method for introducing a getter into a vacuum vessel and for activating the getter in the vacuum vessel, and to a getter unit that is suitable for use in a method of this type.

When, after evacuation, a vacuum vessel is hermetically sealed, the pressure in a vessel of this type tends to rise even if it is impossible for any gas particles to penetrate from the environment into the interior through the vessel walls. The reason for this behavior is gas molecules that are absorbed at the vessel inner walls while the latter is exposed to atmospheric pressure and are released again from the vessel walls in only small quantities and extremely slowly during the evacuation.

To prevent a pressure rise caused by the desorption of such gases in a hermetically sealed vessel, it is known to introduce what are referred to as getter materials, i.e., materials whose surface is able to bond molecules desorbed from the walls of the vacuum vessel significantly more strongly than the vessel walls are able to do. This ability of certain materials is also exploited in ultra-high vacuum technology in what are referred to as getter pumps, the operating principle of which is based on the ionization and electrical acceleration of gas particles that then impinge at high speed on the surface of a getter material, where they are bonded.

For the gettering action, it is always favorable and in many cases even indispensable for the getter material to have been made substantially gas-free prior to the initial uptake of gas. If this does not happen, initially a considerable pressure rise is observed, for example, when a getter pump first starts to operate; this initial pressure rise is attributable to the fact that ions that impinge on the material release large amounts of relatively loosely bonded gas molecules at the surface of this material.

Gettering substances that have taken up gas at relatively high pressures over a prolonged period of time may under certain circumstances act as gas sources at lower pressures, thereby limiting the pressure reduction that can be achieved. Gettering substances that are intended to act alone, i.e., without any additional acceleration of the gas particles that are to be gettered onto the material, therefore, have to be stored packaged in a gastight sleeve in which an atmosphere of a chemically inactive noble gas or vacuum prevails in order to maintain their activity. Before the getter is, then, introduced into a volume that is to be evacuated, it is necessary for the getter to be activated by removal of the protective sleeve. This means that the gettering substance is exposed for a more or less long period of time to a high ambient pressure that saturates its uptake capacity to a greater or lesser extent and, thereby, restricts the activity of the getter. Therefore, when using such getters for the production of products that include a vacuum vessel, it is necessary to keep the time between removal of the getter from the protective sleeve and the evacuation of the vacuum vessel into which the getter has been introduced as short as possible. However, the duration of this period may vary from time to time, and the climatic conditions, in particular, atmospheric humidity and temperature, under which the getter is handled, are also subject to fluctuations over the course of time. Accordingly, the saturation that occurs when the getter is introduced is variable. The amount of getter material that has to be introduced into a vessel that is to be evacuated to enable a predetermined vacuum to be maintained therein for a long period of time, therefore, has to be estimated at a higher level than that corresponding to the nominal, unsaturated uptake capacity of the getter.

In some cases, this represents a very considerable increase in costs.

SUMMARY OF THE INVENTION

It is accordingly an object of the invention to provide a method for introducing and activating a getter in a vacuum vessel, and getter unit that overcome the hereinafore-mentioned disadvantages of the heretofore-known devices and methods of this general type and that that avoids losses in the absorption capacity of the getter over the period of time between its introduction and the evacuation of the vacuum vessel and that provides getter units, in each case including getter material and protective sleeve, which can be used in the method.

With the foregoing and other objects in view, there is provided, in accordance with the invention, a method for introducing and activating a getter in a vacuum vessel, including the steps of introducing the getter packaged in a protective sleeve into the vacuum vessel, closing off and evacuating the vacuum vessel, and opening the protective sleeve after the evacuation has commenced.

The partial saturation of the getter can be avoided in a simple way by initially introducing it into the vacuum vessel in a state in which it is packaged in a protective sleeve, by the vacuum vessel being closed off and evacuated and by the protective sleeve being opened only after the evacuation has commenced, preferably, substantially only once, the desired final pressure of the vacuum vessel is reached.

A first possible way of achieving such a result is for the protective sleeve of the getter to be secured, on one hand, in the vacuum vessel and, on the other hand, to a manipulator that can be moved in the vessel and the sleeve being opened up at the desired time by actuation of the manipulator.

In accordance with another mode of the invention, a particularly simple option is for the protective sleeve to be opened up by the action of gas pressure.

The gas pressure that is active may, on one hand, be the pressure of the surrounding atmosphere, for example, if this pressure deforms the vacuum vessel during the evacuation, with the result that the protective sleeve is opened by the deformation. For such a purpose, the protective sleeve is, preferably, formed from a brittle material that can be destroyed by deformation and can be made to break by contact with the walls of the vacuum vessel as they are deformed.

In accordance with a further mode of the invention, the protective sleeve is broken by contact with the vacuum vessel during the deformation of the vacuum vessel.

Alternatively, the gas pressure that is active may be the pressure of a protective gas in the interior of the protective sleeve, which causes the protective sleeve to burst or open up during the evacuation of the vacuum chamber.

To make the protective sleeve burst or open up through internal pressure, in accordance with an added mode of the invention, it is desirable for the protective sleeve to be formed at least in part from a flexible film that is under prestress. After it has burst, such a film contracts to smaller dimensions than those of the getter material previously surrounded by the film so that the getter material is easily uncovered over a large area and can, thereby, perform its action.

To make such a sleeve burst reliably, in accordance with an additional mode of the invention, it is preferable for a projection to be provided in the interior of the vacuum chamber, against which the sleeve is made to burst as it presses increasingly strongly onto this projection during the evacuation.

In accordance with yet another feature of the invention, the getter is exposed by elastic contraction of the protective sleeve after it has burst or opened.

Alternatively, the protective sleeve may also be composed of a plurality of rigid parts that are pressed against one another under surrounding atmospheric pressure and move apart when the pressure in the vacuum chamber becomes too low to keep the parts pressed together.

With the objects of the invention in view, there is also provided a getter unit, including a getter and a protective sleeve surrounding the getter, the protective sleeve being at least partly formed from a brittle material destroyed by deformation, or from a flexible film.

With the objects of the invention in view, there is also provided a getter unit, including a getter and a protective sleeve surrounding the getter, the protective sleeve having a plurality of rigid parts held together by a pressure difference between an interior of the protective sleeve and the surrounding atmosphere.

The getter unit is to be introduced and activated in a vacuum vessel according to the method of the invention and is opened after the evacuation of the vacuum vessel has commenced.

In accordance with yet a further feature of the invention, the protective sleeve has at least one breaking point.

In accordance with yet an added feature of the invention, the film is under prestress at surrounding atmospheric pressure.

To ensure that the parts move sufficiently far apart in the evacuated state of the vacuum vessel to expose the getter that is present in the protective sleeve over a large area, in accordance with yet an additional feature of the invention, it is preferable for at least one elastic element, which exerts a force driving apart the parts, to be disposed between the parts. As soon as the pressure in the vacuum vessel becomes too low to hold the parts of the sleeve together during the evacuation, they are forced apart by the elastic element.

In accordance with again another feature of the invention, it is expediently also possible for the parts of the sleeve to be articulately connected. In such a case, the sleeve opens up by a pivoting motion when the pressure drops below a critical pressure in the vacuum vessel. Consequently, the parts of the sleeve remain connected to one another so that opening up the sleeve does not necessarily lead to parts that can move freely inside the vacuum vessel. On the other hand, with a configuration of this nature, the elastic element prevents the parts of the sleeve from undesirably closing again.

In accordance with a concomitant feature of the invention, at least one part of the sleeve moves away from the getter by connecting the sleeve to a manipulator actuated from outside the vacuum vessel.

Other features that are considered as characteristic for the invention are set forth in the appended claims.

Although the invention is illustrated and described herein as embodied in a method for introducing and activating a getter in a vacuum vessel and getter unit, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Referring now to the figures of the drawings in detail and first, particularly to FIG. 1 thereof, there is shown various steps involved in an exemplary embodiment of the method according to the invention. FIG. 1 illustrates a vacuum vessel 1, a getter 2, and a protective sleeve 3 that surrounds the getter 2.

The getter 2 may, in this case, be in the form of loose, bulk granules that have already been packaged into the protective sleeve 3 by the manufacturer and divided into suitable portions for the intended application. The getter 2 is under a protective gas atmosphere, which is of inert gas, such as, for example, a noble gas, in particular, argon, or, alternatively, nitrogen, in the protective sleeve 3.

The protective sleeve 3 is in such a case in the form of a flexible, elastically stretchable film made from a plastic that is impermeable to the protective gas.

Figure 1A:
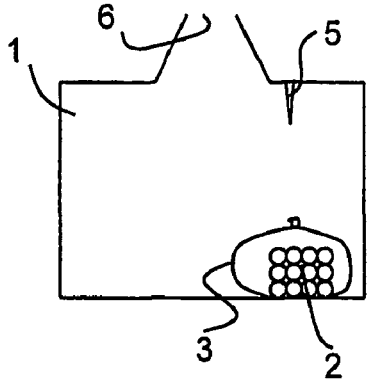
FIGS. 1A, 1B, and 1C are diagrammatic cross-sectional views depicts a sequence of the method according to the invention.
Figure 1B:
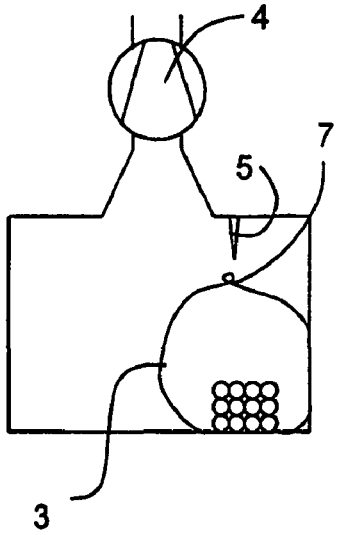

In the stage shown in FIG. 1B, a vacuum pump 4 has been connected to the vessel 1 to evacuate the vessel 1. The pressure drop in the vacuum vessel 1 causes the protective sleeve 3 to inflate to an increasing extent.

According to a first method variant, the size of the protective sleeve 3 and the quantity of the protective gas contained therein are matched to one another such that, during the evacuation, the protective sleeve reaches its stretching limit, and when this stretching limit is reached, the pressure of the protective gas inside the sleeve 3 is sufficient to cause the latter to burst when the pressure in the vacuum vessel surrounding the sleeve drops towards zero. To make the protective sleeve 3 burst reliably, it can be produced from the outset with a weak point 7 that tears open when the pressure drops below the limit pressure.

Figure 1C:
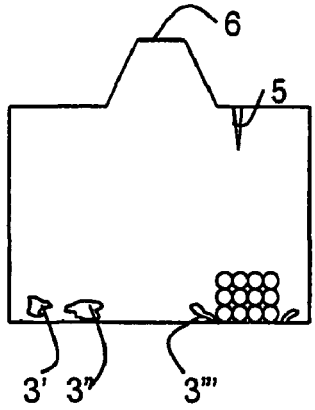

As an alternative or in addition, it is possible, as illustrated in FIGS. 1A to 1C, for the vacuum vessel 1 to be provided with an inwardly directed projection or mandrel 5, onto which the protective sleeve 3 starts to press during the evacuation until it ultimately bursts.

Fragments 3', 3", . . . of the protective sleeve remain inside the vacuum vessel 1 after the evacuation has ended and the evacuation connection piece 6 has been closed off, as can be seen from FIG. 1C. To ensure that the fragments 3', 3" of the protective sleeve 3 do not cover the getter 2, thereby impeding its action, after the sleeve has burst, it is advantageous if the protective sleeve 3 has already been prestressed and stretched at the time when it is introduced into the vacuum vessel so that, after the sleeve has burst, the fragments contract to the original, unstretched size of the film, in which its dimensions are insufficient to cover the getter 2.

Figure 2A:
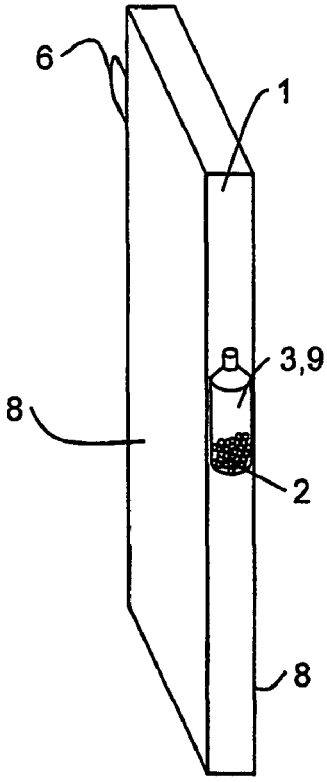
FIGS. 2A and 2B are perspective and partially sectional views illustrating method steps in accordance with a second configuration of the invention.

FIG. 2A shows an alternative method for introducing and activating a getter that can be applied to vacuum vessels that are deformed during the evacuation. FIG. 2A shows a perspective, partially sectional view of a plate-like or disk-like vacuum vessel 1 with two opposite, large-area side walls 8.

In FIG. 2A, a getter 2, the protective sleeve 3 of which is, in this case, in the form of a vial or bottle 9, is located between the two side walls 8. The shape of the bottle or vial 9 and of the vacuum vessel 1 can be matched to one another such that the vial 9 can be introduced into the vessel through the evacuation connection piece 6 and can slide, for example through non-illustrated guide elements, into an approximately central position between the two side walls 8, where it is held in place.

Figure 2B:
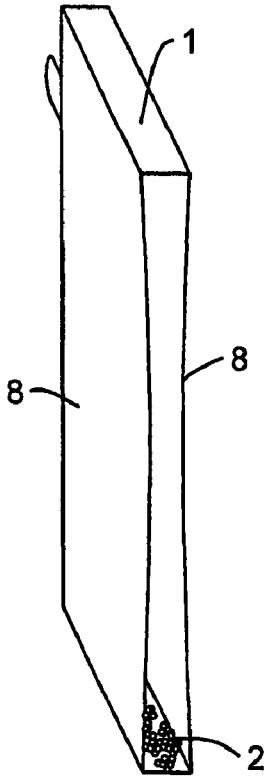

During the evacuation of the vacuum vessel 1, the two large-area side walls 8 are pressed together by the surrounding atmospheric pressure. As a result, they exert a considerable pressure on the vial 9, which ultimately breaks and releases the getter 2 contained therein. FIG. 2B shows the getter 2, as well as the fragments of the vial 9, scattered over the bottom of the vacuum vessel 1.

If, in this method variant, the vial 9 does not break as desired, this will be apparent from the outside, on account of the fact that the side walls 8, then, do not have the expected concave shape. In a situation of this nature, it is possible to subsequently make the vial 9 break by carefully tapping on one of the side walls 8.

Figure 3:
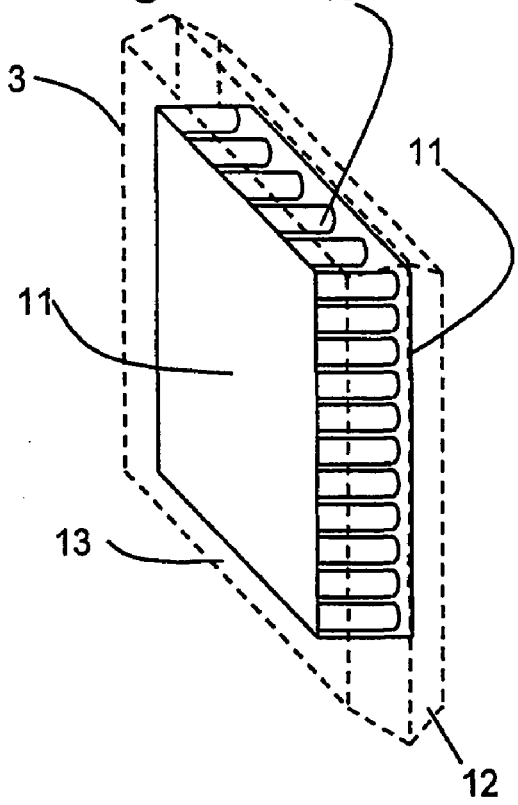
FIG. 3 is a partially hidden and perspective view of an example getter unit suitable for carrying out the method illustrated in FIG. 2.

It is not desirable for all applications for the getter 2 to be able to move freely in the vacuum vessel 1 after it has been released from the protective sleeve. FIG. 3 shows a getter unit that complies with such a requirement. Gettering-active material has, in the case of FIG. 3, been applied to a multiplicity of rod-like carriers 10 that extend between two side plates 11. Such a getter configuration is, once again, accommodated in a protective sleeve 3 made from a brittle, frangible material. The protective sleeve 3 has large-area side walls 13 that cover the side plates 11 and narrow side walls 12 that connect the large-area side walls 13. The getter unit can be placed in such a form in a vacuum vessel 1, such as that shown in FIG. 2, with the side plates 11 in each case facing the large-area side walls 8. During the evacuation of the vacuum vessel 1, the protective sleeve 3 shown in dashed lines in FIG. 3 breaks in the region of its narrow side walls 12, whereas the large-area side walls 13 remain jammed between the side plates 11 and the side walls 8 of the vessel 1. Therefore, in the exemplary embodiment shown in FIG. 3, the getter remains in a fixed position after the protective sleeve 3 has broken, and also the protective sleeve 3, itself, produces only a relatively small quantity of fragments that may move about and emanate from the narrow side walls 12.

Figure 4:
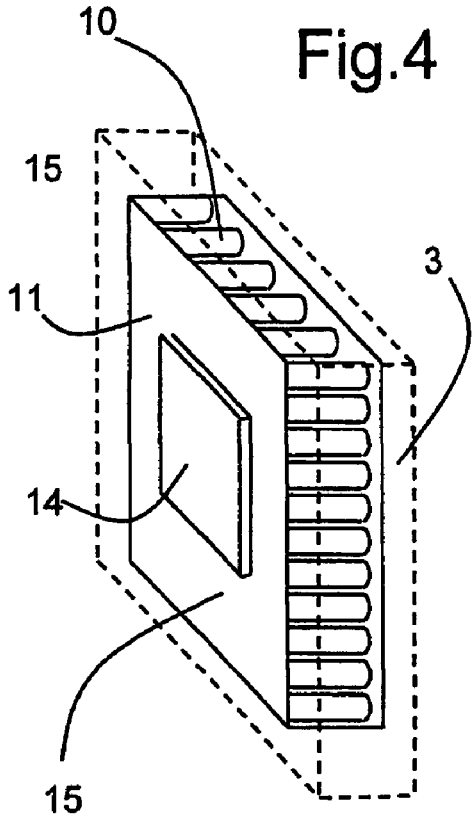
FIG. 4 is a partially hidden and perspective view of a getter unit for a modification of the method illustrated in FIG. 1.

FIG. 4 shows a getter element that is, once again, packaged in an elastic film as protective sleeve 3. The structure of this getter element with carriers 10 for the active material and side plates 11 is substantially the same as that of the getter element shown in FIG. 3. In the case of FIG. 4, the side plates 11 each have at least one approximately central projection 14 that, during the evacuation of a vacuum vessel 1 of the configuration shown in FIG. 2, comes into contact with the large-area side walls 8 of this vessel. When, in this embodiment, the prestressed elastic film, from which the protective sleeve 3 is made, tears, in each case part of the protective sleeve 3 is clamped between a projection 14 and the opposite side wall 8. The result of this is that, after the film has burst, the fragments that form substantially withdraw into the space between the side wall 8 and the peripheral region 15 of the side plate 11 that surrounds the projection 14, as a result of elastic contraction. This ensures in a simple way that, after the film has burst, the active surface of the getter element is exposed, so that the getter is activated.

Figure 5:
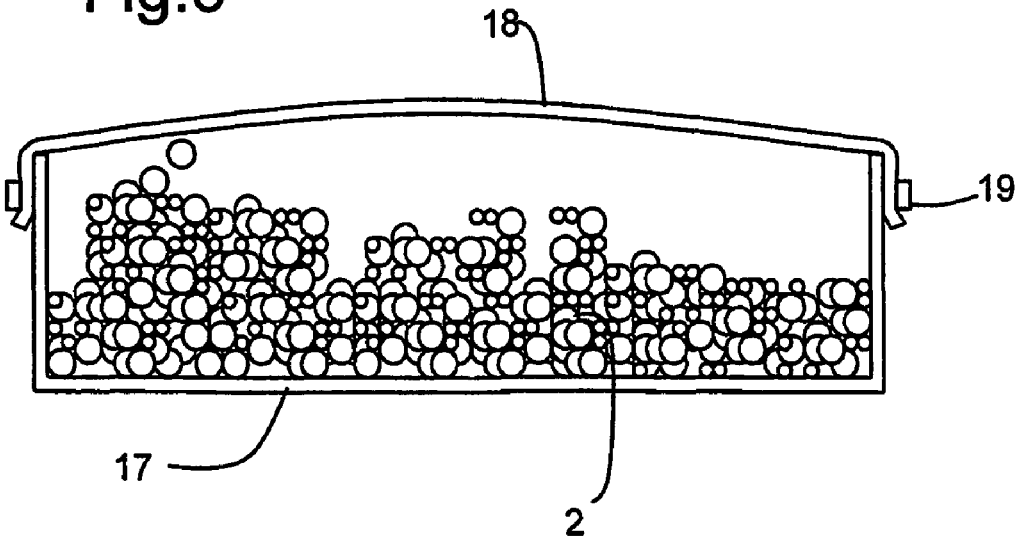
FIG. 5 is a cross-sectional view of a getter unit according to the invention having a sleeve including a dish closed off by a film.

FIG. 5 shows a further example of a getter unit according to the invention. In such a case, the getter 2 is located in a rigid dish 17, for example, made from sheet steel or aluminum, the top side of which is closed off by a flexible, prestressed film 18. In such a case, the film 18 is shown curving outward under the pressure of a protective gas atmosphere surrounding the getter 2. The getter 2 may be in the form of a loose bed in the dish 17 or, depending on the getter material used, may be secured to the dish in any suitable way. The film 18 is secured to the edge of the dish 17 in any suitable way, e.g., by welding or adhesive bonding or, as shown here, with the aid of a retaining strap or a hose clip 19.

As has already been described with reference to FIGS. 1A to 1C, the protective gas enclosed between the dish 17 and the film 18, during the evacuation of a vacuum vessel with the getter unit inside it, causes the film 18 to burst or spring open so that the getter 2 is activated.

Figure 6:
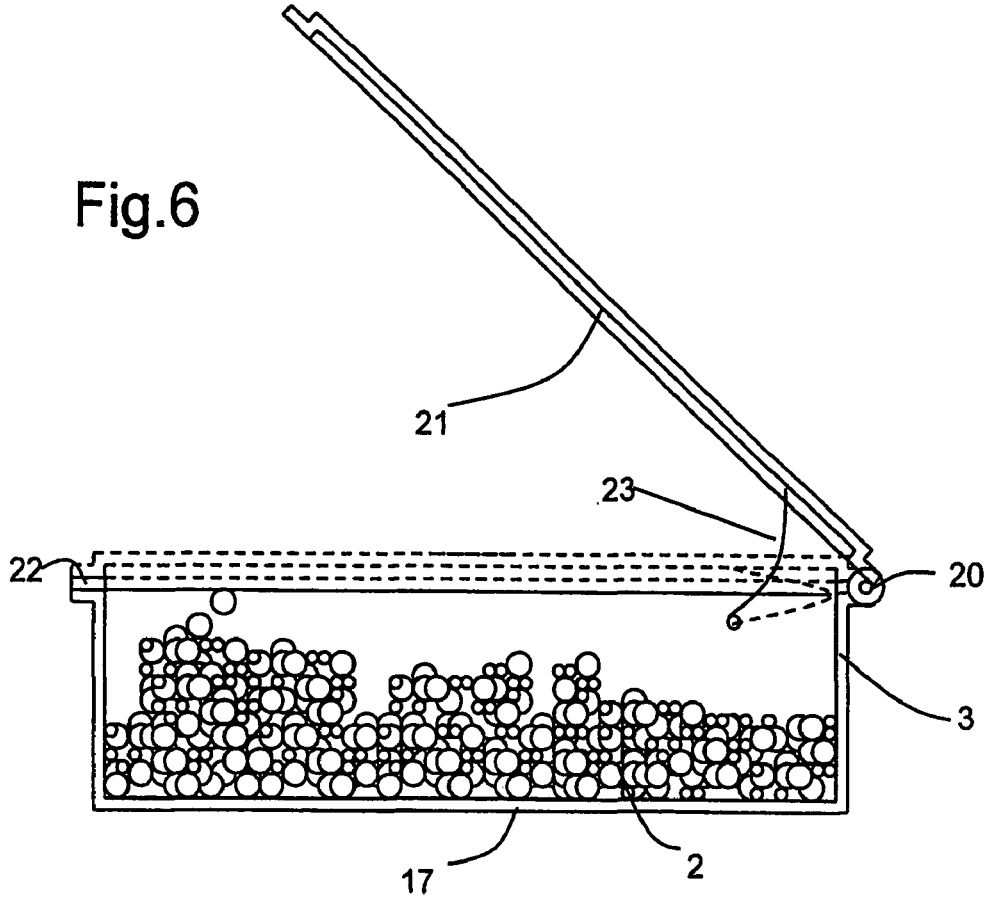
FIG. 6 is a cross-sectional view of a getter unit according to the invention having a protective sleeve composed of two articulately connected parts.
Figure 7:
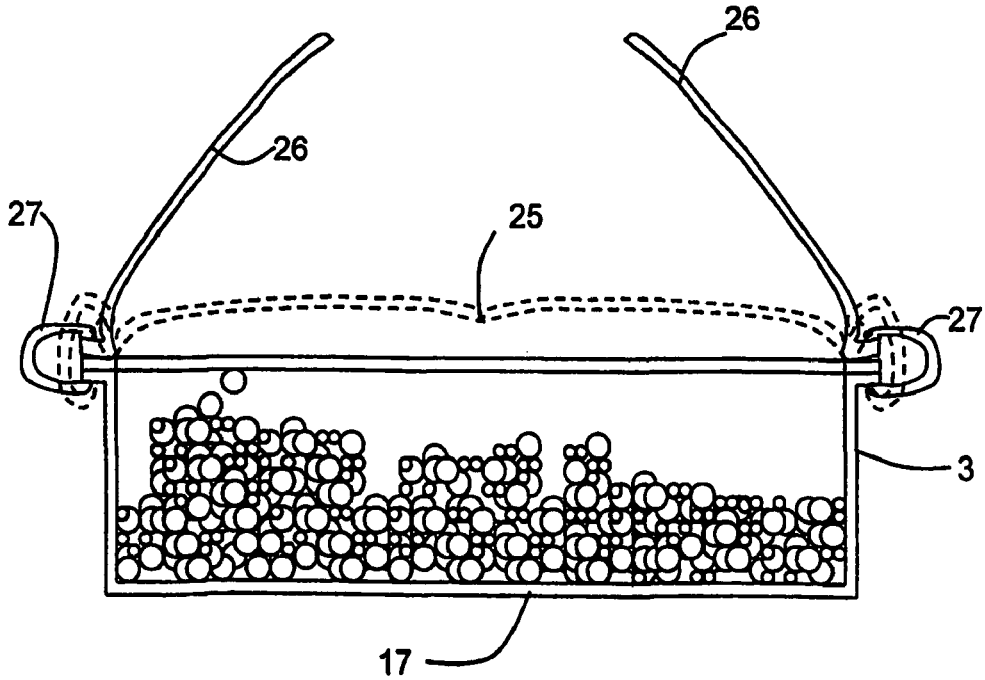
FIG. 7 is a cross-sectional view of a getter unit according to the invention having a protective sleeve with a desired breaking point.

FIGS. 6 and 7 show two configurations of a getter unit that includes a getter 2 and its protective sleeve and in which the protective sleeve 3 is composed only of rigid parts. In the case of the getter unit shown in FIG. 6, the protective sleeve 3 is in the form of a shallow box having a lower dish 17 and a lid 21 that is connected to the dish 17 by an articulated joint 20. The lid 21 is shown in the closed state by dashed lines and in the open state by solid lines. A seal 22 is disposed between the dish 17 and the lid 21. The dish 17 is filled with the getter 2. Prior to use, the interior of the protective sleeve 3 is evacuated, or the getter 2 inside it is exposed to a protective gas atmosphere at a pressure that is lower than atmospheric pressure. The reduced pressure prevailing in the protective sleeve 3 keeps the dish 17 and lid 21 pressed securely together prior to use. A leaf spring 23 disposed between the dish 17 and the lid 21 exerts a force on the two components that seeks to open the lid 21 but is not strong enough to overcome the atmospheric pressure acting against it.

When the getter unit has been introduced into a vacuum vessel and the evacuation has commenced, the pressure that acts on the protective sleeve from the outside will ultimately become so low that the leaf spring 23 is able to pivot the lid into the open position illustrated by solid lines in FIG. 6. The pressure difference between the interior of the protective sleeve and the surrounding vacuum vessel is, at this point, low enough so that there is no possibility of the getter 2 being scattered when the protective sleeve opens, even if the getter is not fixed inside the dish 17.

In the configuration shown in FIG. 7, the protective sleeve 3 is, once again, composed of a rigid dish 17 and a lid, the lid in this case being composed of two halves 26 that are delimited from one another by a desired breaking point 25. Two powerful leaf springs 27 that exert a load on the desired breaking point 25 as a result of lever action and seek to break open the two halves 26 are disposed on the outside of the protective sleeve 3. In such a case, too, the interior of the protective sleeve 3 is under a sub-atmospheric pressure or evacuated prior to use, and the strength of the leaf spring 27 and/or the desired breaking point 25 are such that only during the evacuation does the force of the springs 27 become sufficient to overcome a pressure that acts on the lid from the outside and to break open and open the lid at the desired breaking point 25.

Figure 8:
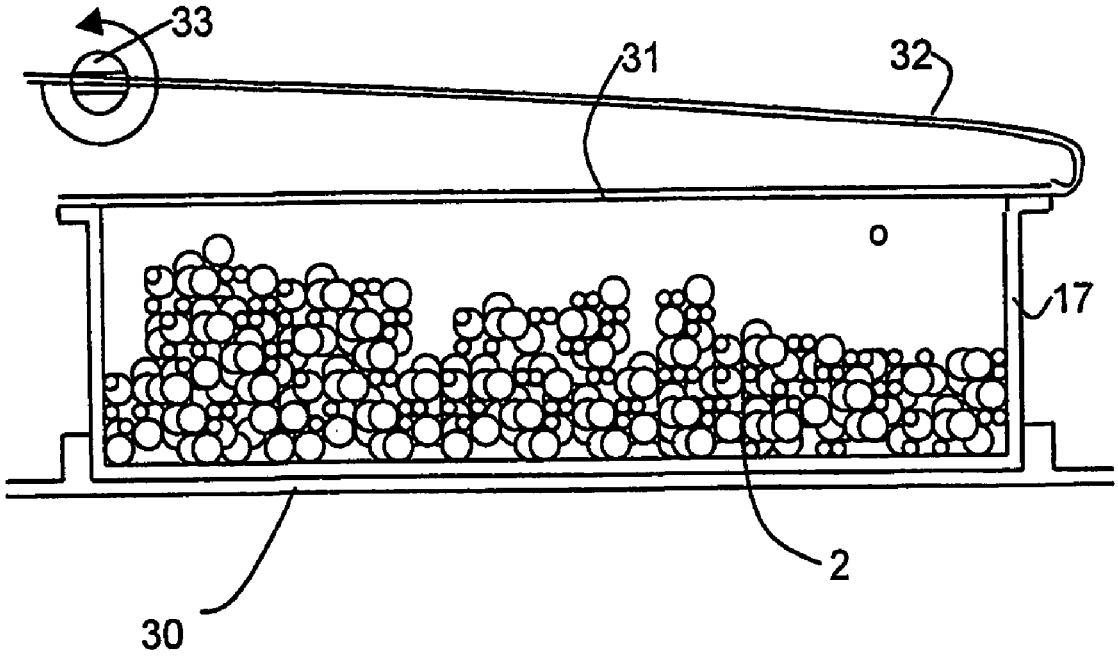
FIG. 8 is a cross-sectional view of a getter unit according to the invention mounted on a wall.

FIG. 8 shows a further example of a getter unit that is mounted fixedly on a wall 30 of a vacuum vessel, for example, by latching measures. The protective sleeve 3 of the getter unit includes a shallow dish 17, which accommodates the getter 2, and a film 31 that is adhesively bonded, welded, or secured in a sealed manner in some other suitable way to the upper edge of the dish. The film is extended by a tab 32, the end of which is secured to a rotatable pin 33. The pin 33 may be part of a rotary leadthrough actuated from outside the vacuum vessel but may also, for example, be coupled to a valve for opening or closing the evacuation connection piece of the vacuum vessel. When the pin 33 is rotated after a pump has been connected or the vacuum vessel evacuated, first, the tab 32 is pulled taut, and, then, gradually the film 31 is pulled off the upper edge of the dish 17 so that the getter 2 is exposed.

We claim:

1. A method for introducing and activating a getter in a vacuum vessel, which comprises:

introducing the getter packaged in a gastight flexible film protective sleeve filled with a protective gas into the vacuum vessel;

closing off and evacuating said vacuum vessel; and opening said protective sleeve after the evacuation has commenced by filling said gastight protective sleeve with a protective gas; and bursting said sleeve by evacuating said vacuum chamber and causing said protective sleeve to be expanded against a projection formed in an interior wall of said vacuum chamber.

* * * * *